US010907450B2

(12) United States Patent
Maughan et al.

(10) Patent No.: US 10,907,450 B2
(45) Date of Patent: Feb. 2, 2021

(54) SURFACE PRESSURE CONTROLLED GAS VENT SYSTEM FOR HORIZONTAL WELLS

(71) Applicant: General Electric Company, Schenectady, NY (US)

(72) Inventors: James Rollins Maughan, Brunt Hill, NY (US); Jeremy Daniel Van Dam, West Coxsackie, NY (US); Kalpesh Singal, Glenview, NY (US); Chengkun Zhang, Rexford, NY (US)

(73) Assignee: GENERAL ELECTRIC COMPANY, Schnectady, NY (US)

( * ) Notice: Subject to any disclaimer, the term of this patent is extended or adjusted under 35 U.S.C. 154(b) by 655 days.

(21) Appl. No.: 14/969,915

(22) Filed: Dec. 15, 2015

(65) Prior Publication Data

US 2017/0167228 A1 Jun. 15, 2017

(51) Int. Cl.
*E21B 43/00* (2006.01)

(52) U.S. Cl.
CPC ..... *E21B 43/00* (2013.01)

(58) Field of Classification Search
CPC ..... E21B 43/00
USPC ..... 166/250.1
See application file for complete search history.

(56) References Cited

U.S. PATENT DOCUMENTS

| | | | | |
|---|---|---|---|---|
| 5,211,242 | A | 5/1993 | Coleman et al. | |
| 5,544,672 | A | 8/1996 | Payne et al. | |
| 6,758,277 | B2 | 7/2004 | Vinegar et al. | |
| 7,210,530 | B2 | 5/2007 | Lush et al. | |
| 7,445,049 | B2 * | 11/2008 | Howard | E21B 43/12 166/372 |
| 8,113,288 | B2 | 2/2012 | Bachtell et al. | |
| 8,122,966 | B2 | 2/2012 | Kelley | |
| 8,794,305 | B2 | 8/2014 | Wilson | |
| 8,985,221 | B2 | 3/2015 | Mazzanti | |
| 2015/0252657 | A1 * | 9/2015 | Dykstra | E21B 7/04 166/305.1 |

OTHER PUBLICATIONS

Yoshioka, K. et al., A New Inversion Method to Interpret Flow Profiles From Distributed Temperature and Pressure Measurement in Horizontal Wells, SPE Annual Technical Conference and Exhibition, Nov. 11-14, 2007, pp. 1-23, Anaheim, California.

* cited by examiner

*Primary Examiner* — Matthew R Buck
*Assistant Examiner* — Patrick F Lambe

(57) ABSTRACT

A gas vent system for use in a wellbore that includes a substantially horizontal portion is provided. The gas vent system includes a gas vent conduit positioned within the wellbore. The gas vent conduit defining a gas vent intake passage situated within the substantially horizontal portion of the wellbore and configured to facilitate a flow of gaseous substances therethrough. A gas vent valve coupled to the gas vent conduit and situated outside the wellbore. The gas vent valve controls the flow of gaseous substances through the gas vent conduit.

19 Claims, 5 Drawing Sheets

SURFACE PRESSURE CONTROLLED GAS VENT SYSTEM FOR HORIZONTAL WELLS

BACKGROUND

This disclosure relates generally to oil or gas producing wells, and, more specifically, the disclosure is directed to horizontal wells having a gas vent system for removing gas from a wellbore.

The use of directionally drilled wells to recover hydrocarbons from subterranean formations has increased significantly in the past decade. The geometry of the wellbore along the substantially horizontal portion typically exhibits slight elevation changes, such that one or more undulations (i.e., "peaks" and "valleys") occur. In at least some known horizontal wells, the transport of both liquid and gas phase materials along the wellbore results in unsteady flow regimes including terrain-induced slugging, such as gas slugging. Fluids that have filled the wellbore in lower elevations impede the transport of gas along the length of the wellbore. This phenomenon results in a buildup of pressure along the length of the substantially horizontal wellbore section, reducing the maximum rate at which fluids can enter the wellbore from the surrounding formation. Continued inflow of fluids and gasses cause the trapped gas pockets to build in pressure and in volume until a critical pressure and volume is reached, whereby a portion of the trapped gas escapes past the fluid blockage and migrates as a slug along the wellbore. Furthermore, at least some known horizontal wells include pumps that are designed to process pure liquid or a consistent mixture of liquid and gas. Not only does operating the pump without pure liquids cause much lower pumping rates, but it may cause damage to the pump or lead to a reduction in the expected operational lifetime of the pump.

To cope with this type of terrain-induced slugging, one conventional technique includes the utilization of a gas vent tube, situated within the wellbore, that includes multiple mechanical valves distributed at various gas tube access points throughout the length of the wellbore. Each mechanical valve within the wellbore, for this conventional technique, is capable of remaining closed in the presence of liquid and opening passage to the gas tube vent in the absence of liquid. In this conventional manner, those mechanical valves located in a "valley" or at a relatively lower elevation horizontal wellbore undulation are configured to remain closed, preventing the ingress of liquid into the gas vent tube. On the other hand, those mechanical valves located at a "peak" or at a relatively higher elevation horizontal wellbore undulation are configured to automatically open to allow gas to enter the gas vent tube and escape to the surface. These mechanical valves may be passive valves or may be active valves that include one or more sensors (e.g., fluid sensors) to assist in determining the actuation of one or more valves. However, the reliability of mechanical valves, especially when thousands of feet under the surface, is problematic. Moreover, the utilization of active mechanical valves in a gas vent tube becomes even more cumbersome since a power supply and power delivery to each downhole active valve is required.

Similarly, another conventional technique includes replacing each mechanical valve with a gas-permeable membrane barrier that only allows the passage of gas, as opposed to liquid. The gas-permeable membrane may be pressure differential induced or merely allow gas molecules of particular sizes passage through the membrane. However, similar to a mechanical valve, gas-permeable membranes face reliability issues such as fouling (i.e., micro-passages for gas molecules become blocked by sand and debris) especially when situated in the harsh environment thousands of feet downhole. The pressure differentials across a gas-permeable membrane may also cause issues with reliability and purging the gas vent tube may require a much higher volume and pressure of gas due to purge gas leaking out of each gas-permeable membrane.

BRIEF DESCRIPTION

A gas vent system for use in a wellbore that includes a substantially horizontal portion is provided. The gas vent system includes a gas vent conduit positioned within the wellbore. The gas vent conduit defining a gas vent intake passage situated within the substantially horizontal portion of the wellbore and configured to facilitate a flow of gaseous substances therethrough. A gas vent valve coupled to the gas vent conduit and situated outside the wellbore. The gas vent valve controls the flow of gaseous substances through the gas vent conduit.

A method of venting gas from a wellbore that includes a substantially horizontal portion is provided. The method includes positioning a gas vent conduit within the wellbore. The gas vent conduit including a gas vent intake passage situated within the substantially horizontal portion of the wellbore. The method also includes facilitating a first flow of gaseous substances through the gas vent conduit. The first flow of gaseous substances through the gas vent conduit is controlled by a gas vent valve situated outside the wellbore.

A controller for use in venting gas from a wellbore that includes a substantially horizontal portion is provided. The controller is configured to open a gas vent valve to a first position that facilitates a first flow of gaseous substances through a gas vent conduit. The controller is also configured to receive a first gas vent flow measurement from a first rate of flow of gaseous substances through a gas vent conduit and adjust the gas vent valve to a second position that facilitates a second rate of flow of gaseous substances through the gas vent conduit based on the first gas vent flow measurement.

DRAWINGS

These and other features, aspects, and advantages of the present disclosure will become better understood when the following detailed description is read with reference to the accompanying drawings in which like characters represent like parts throughout the drawings, wherein.

Figure 1:
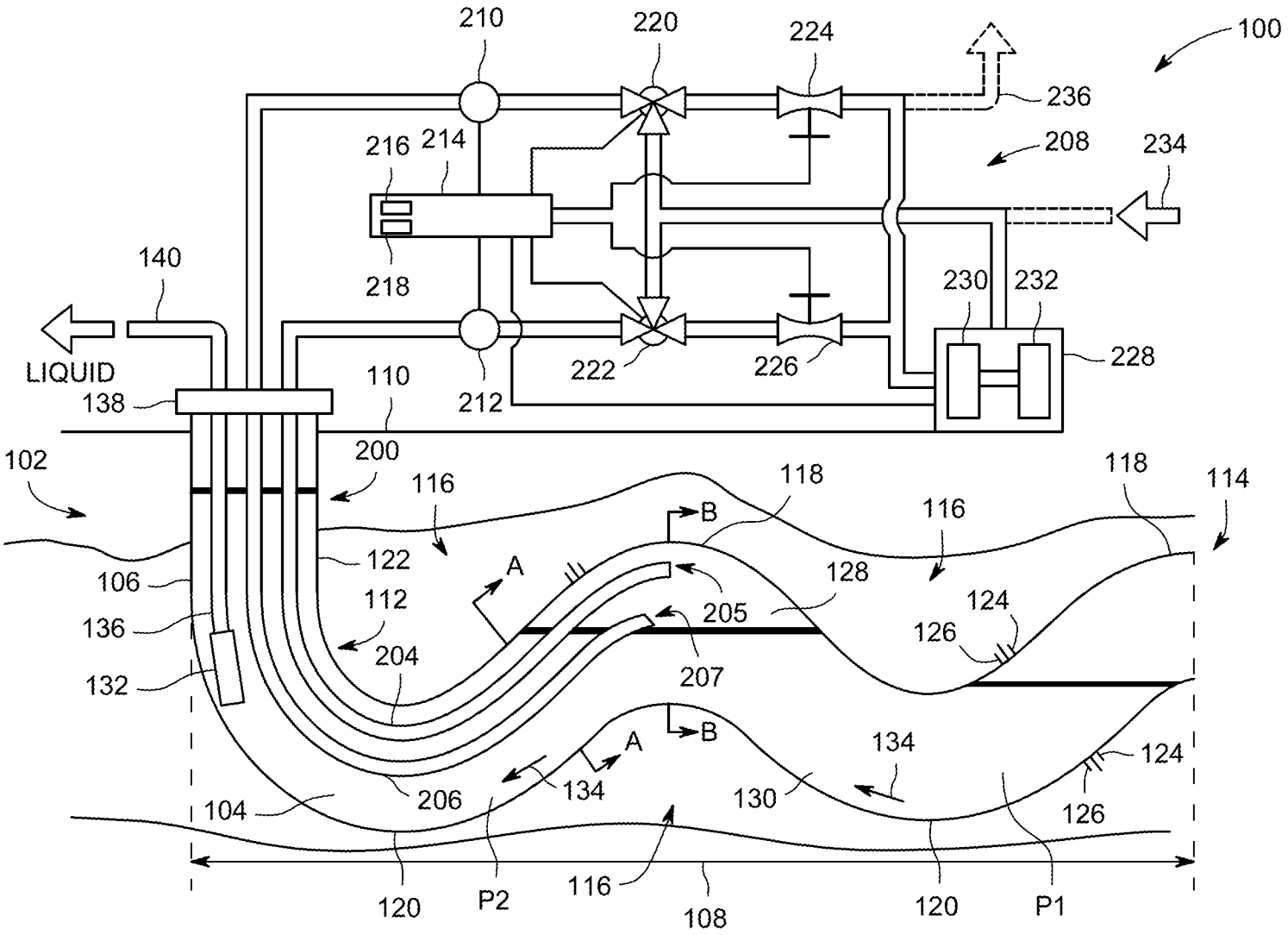
FIG. 1 is a schematic view of an exemplary horizontal well including an exemplary gas vent system.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations are combined and interchanged, such ranges are identified and include all the sub-ranges contained therein unless context or language indicates otherwise.

As used herein, the terms "processor" and "computer," and related terms, e.g., "processing device," "computing device," and "controller" are not limited to just those integrated circuits referred to in the art as a computer, but broadly refers to a microcontroller, a microcomputer, a programmable logic controller (PLC), and application specific integrated circuit, and other programmable circuits, and these terms are used interchangeably herein. In the embodiments described herein, memory may include, but it not limited to, a computer-readable medium, such as a random access memory (RAM), a computer-readable non-volatile medium, such as a flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Further, as used herein, the terms "software" and "firmware" are interchangeable, and include any computer program storage in memory for execution by personal computers, workstations, clients, and servers.

As used herein, the term "non-transitory computer-readable media" is intended to be representative of any tangible computer-based device implemented in any method of technology for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including without limitation, volatile and non-volatile media, and removable and non-removable media such as firmware, physical and virtual storage, CD-ROMS, DVDs, and any other digital source such as a network or the Internet, as well as yet to be developed digital means, with the sole exception being transitory, propagating signal.

Furthermore, as used herein, the term "real-time" refers to at least one of the time of occurrence of the associated events, the time of measurement and collection of predetermined data, the time to process the data, and the time of a system response to the events and the environment. In the embodiments described herein, these activities and events occur substantially instantaneously.

The horizontal well systems described herein facilitate efficient methods of well operation. Specifically, in contrast to many known well operations, the horizontal well systems as described herein substantially remove gaseous substances from a wellbore to substantially reduce the formation of gas slugs. More specifically, the horizontal well systems described herein include a gas vent system that includes at least one gas vent conduit positioned to include a gas vent intake passage in a horizontal portion of a wellbore. Moreover, in some embodiments, the gas vent system may include a gas probe conduit positioned to include a gas probe intake passage in the horizontal portion of the wellbore. The gas vent conduit is coupled to a gas vent choke valve, situated outside the wellbore, that facilitates and controls a flow of gaseous substances to the surface. On the other hand, the gas probe conduit includes an orifice situated outside the wellbore, that facilitates a flow of gaseous substances to the surface. In other embodiments, the gas probe conduit may be coupled to a gas probe choke valve, situated outside the wellbore, that facilitates and controls a flow of gaseous substances to the surface. A controller may receive flow (and/or pressure) measurement signals from sensors positioned to monitor the flow (and/or pressure) of the passage of gaseous substances through the gas vent conduit and gas probe conduit, respectively. In turn, the controller may generate one or more control signals, based on the flow measurements from one or both sensors, and transmit the control signal(s) to the gas vent choke valve or the gas probe choke valve that command the closing or opening of the passage(s) via an actuator. Furthermore, the controller may communicate control signals to a gas vent control valve, a gas probe control valve, and/or a gas multiplier. Advantageously, the gas vent system facilitates for more efficient removal of gaseous substances from the horizontal portion of a wellbore, and thus, reducing or eliminating the presence (and problems) of gas slugs in a liquid well operation. As a result, the more efficient removal of liquid through quicker liquid flow rates and longer lifespans of the liquid pump are facilitated.

As such, the gas vent systems described herein provide gaseous substances with an escape path that bypasses the pump and removes substantially all of the gaseous substances from within the horizontal portion of the wellbore prior to the gases reaching the pump such that only the liquid mixture encounters the pump. If the pump is set at a depth with some elevation above the depth of the gas vent intake, then some gas may break out of solution as the fluid reaches the pump, but existing pump technologies have been shown to operate successfully with limited quantities of gas bubbles that are well mixed with the fluid. The breakout gas will not form large gas slugs that interfere with pump performance. Alternatively, the gas vent systems described herein are used in horizontal wells that seek to recover only gaseous substances, and, therefore, do not include a pump. Accordingly, the gas vent systems described herein substantially eliminate both the buildup of pressure upstream from the pump and the formation of slugs, as described above. More specifically, the gas vent system described herein substantially reduces the buildup of pressure within the wellbore such that the horizontal portion of the wellbore achieves a nearly constant minimum pressure along its length and enables a maximized production rate and total hydrocarbon recovery of the horizontal well.

FIG. 1 is a schematic illustration of an exemplary horizontal well system 100 for removing materials from a well 102. In the exemplary embodiment, well 102 includes a wellbore 104 having a substantially vertical portion 106 and a substantially horizontal portion 108. Vertical portion 106 extends from a surface level 110 to a heel 112 of wellbore 104. Horizontal portion 108 extends from heel 112 to a toe 114 of wellbore 104. In the exemplary embodiment, horizontal portion 108 follows a stratum 116 of hydrocarbon-containing material formed beneath surface 110, and, therefore, includes a plurality of peaks 118 and a plurality of valleys 120 defined between heel 112 and toe 114. Moreover, horizontal portion 108 may include an updip (i.e., a portion sloping upward in elevation between a valley and a peak toward toe 114) and a downdip (i.e., a portion sloping downward in elevation between a peak and a valley toward toe 114). As used herein, the term "hydrocarbon" collectively describes oil or liquid hydrocarbons of any nature, gaseous hydrocarbons, and any combination of oil and gas hydrocarbons.

Wellbore 104 includes a casing 122 that lines portions 106 and 108 of wellbore 104. Casing 122 includes a plurality of perforations 124 in horizontal portion 108 that define a plurality of production zones 126. Hydrocarbons from stratum 116, along with other liquids, gases, and granular solids, enter horizontal portion 108 of wellbore 104 through production zones 126 through perforations 124 in casing 122 and substantially fills horizontal section 108 with gas substances 128 and a mixture 130 of liquids and granular solids. In the exemplary embodiment, "liquid" includes water, oil, fracturing fluids, or any combination thereof, and "granular solids" include relatively small particles of sand, rock, and/or engineered proppant materials that are able to be channeled through perforations 124.

Horizontal well system 100 also includes a pump 132 positioned proximate heel 112 of wellbore 104. Pump 132 is configured to draw liquid mixture 130 through horizontal portion 108 such that liquid mixture 130 flows in a direction 134 from toe 114 to heel 112. Pump 132 is fluidly coupled to a production tube 136 that extends from a wellhead 138 of well 102. Production tube 136 is fluidly coupled to a liquid removal line 140 that leads to a liquid storage reservoir (not shown), for example. In one embodiment, liquid removal line 140 may include a filter (not shown) to remove the granular solids from liquid mixture 130 within line 140. Pump 132 is operated by a driver mechanism (not shown) that permits pumping of liquid mixture 130 from wellbore 104. In operation, liquid mixture 130 travels from pump 132, through production tube 136 and liquid removal line 140.

In the exemplary embodiment, horizontal well system 100 further includes a gas vent system 200 that is configured to channel primarily gaseous substances 128 from within horizontal portion 108 of wellbore 104 such that gaseous substances 128 are provided with an escape path from wellbore 104 that is independent of an escape path, i.e., production tube 136, for liquid mixture 130. Gas vent system 200 includes a gas vent conduit 204 including gas vent intake passage 205 and a gas probe conduit 206 including gas probe intake passage 207, both conduits which are coupled to surface equipment 208. In the exemplary embodiment, gas vent conduit 204 is configured to channel primarily gaseous substances 128 from within horizontal portion 108 of wellbore 104 through wellhead 138 to surface equipment 208. Generally, gas vent conduit 204 channels gas 128 to any location that facilitates operation of gas vent system 200 as described herein. Both gas vent intake passage 205 and gas probe intake passage 207 may be positioned in different orientations from each other, such as being situated at different elevations or different locations within wellbore 104.

Surface equipment 208 includes a gas probe control valve 220 (e.g., three-way valve) coupled to gas probe conduit 206 that channels the gaseous substances 128 to a gas multiplier 228 or alternatively, a gas storage tank (not shown). Furthermore, gas probe control valve 220 is coupled to a gas probe choke valve 224 or any other suitable high pressure valve for controlling the flow rate of gaseous substances 128 and, in turn, the gas probe choke valve 224 is coupled to gas multiplier 228. In another embodiment, gas probe control valve 220 may be replaced with an orifice located outside the wellbore so that the gas probe conduit may freely facilitate gaseous substances from the wellbore to surface. Likewise, surface equipment 208 includes a gas vent control valve 222 (e.g., three-way valve) coupled to gas vent conduit 204 that channels the gaseous substances 128 to gas multiplier 228 or alternatively, a gas storage tank (not shown). Moreover, gas vent control valve 222 is coupled to a gas vent choke valve 226 (or any other suitable high pressure valve for controlling the flow rate of gaseous substances 128) and, in turn, the gas vent choke valve 226 is coupled to gas multiplier 228. Gas multiplier 228 includes a gas pressurizer 230 (or gas accumulator) and a pressurized gas purge tank 232 and facilitates the purging of gas vent conduit 204 and/or gas probe conduit 206 (discussed below). A high pressure pipeline 234 may also be utilized in purging either conduit 204, 205. Additionally or alternatively, any excess gaseous substances 128 evacuated from the wellbore may be disposed of through a flare 236.

Additionally, surface equipment 208 includes sensors 210, 212, such that sensor 210 is coupled to gas probe conduit 206 and sensor 212 is coupled to gas vent conduit 204. These sensors 210, 212 includes a flow sensor or meter of any type, such as a turbine flow meter, Venturi meter, optical flow meters, or any other suitable flow meter, that operably measures or quantifies the rate of flow of gaseous substances through a conduit and generate an electronic signal (e.g., digital or analog). This periodic or aperiodic electronic signal is generated at a substantially instantaneous flow rate measurement or include a delay. Alternatively or additionally, sensors 210, 212 includes a pressure sensor of an type (e.g., manometer, piezoelectric, capacitive, optical, electromagnetic, etc.) that measures a pressure of the gas in the conduit.

Moreover, a process controller 214 is communicatively coupled to sensors 210, 212 and includes a processor 216 and a memory 218 that are configured to receive and store measurement monitoring signals from the sensors 210, 212. In turn, processor 216 and memory 218 executes control routines or loops to generate one or more control signals to control any piece of the surface equipment 208 (discussed below). These control routines, executed by controller 214 via processor 216 and memory 218, are configured to generate one or more control signals based any number of control algorithms or techniques, such as proportional-integral-derivative (PID), fuzzy logic control, model-based techniques (e.g., Model Predictive control (MPC), Smith Predictor, etc.), or any other control technique including adaptive control techniques.

Controller 214 generates and transmit one or more control signals to instruct or control valves 220-226 (and optionally gas multiplier 228). For example, controller 214 receives a flow measurement monitoring signal from sensor 210. In response to determining that the flow measurement monitoring signal is relatively a high value, controller 214 generates and transmits to gas vent choke valve 226 a control signal that commands the incremental opening of the passage through gas vent choke valve 226, facilitating the flow of gaseous substances 128 from the gaseous pocket(s) in the wellbore. On the other hand, in response to determining that the flow measurement monitoring signal is relatively a low value, controller 214 generates and transmits to gas vent choke valve 226 a control signal that commands the incremental closing of the passage through gas vent choke valve 226, restricting the volume and flow of gaseous substances 128 from the gaseous pocket(s) in wellbore.

As shown in FIG. 1, during operation of horizontal well system 100, substances 128 and 130 enter horizontal portion 108 of wellbore 104 through production zones 126 such that the more dense mixture of liquids and granular solids collect in valleys 120 of portion 108 and less dense gaseous substances 128 collect in peaks 118. Accordingly, gas vent conduit 204 and gas probe conduit 206 of gas vent system 200 provide gaseous substances 128 with an escape path that bypasses pump 132 and removes a majority of gaseous substances 128 from within horizontal portion 108 of wellbore 104 prior to gases 128 reaching pump 132 such that only a substantially liquid mixture 130 encounters pump 132. Therefore, gas vent system 200 substantially eliminates the formation of slugs, described above, and reduces gas intake of pump 132. Despite FIG. 1 only showing one gas vent conduit 204 and one gas probe 206, any number of pairs of gas vent conduits and gas probe conduits may be utilized at each gas pocket of each peak 118 (or updip) to remove gaseous substances 128 from each peak 118. Alternatively, in some embodiments, gas vent system 100 utilizes only one gas vent conduit per gas pocket of each peak 118.

More specifically, gas vent system 200 substantially reduces the buildup of pressure within horizontal portion 108 of wellbore 104 such that a pressure at a first point P1, proximate toe 114, is substantially similar to a pressure at a second point P2, proximate heel 112. More specifically, gas vent system 200 removes the increase in pressure along horizontal portion 108 due to liquid blockage of pressurized gas pockets. However, some pressure differences along portion 108 will remain due to elevation changes and the weight of liquid mixture 130, where lower elevations have higher pressures. As a result, each production zone 126 along horizontal portion 108 has a substantially uniform production rate with respect to wellbore pressure rather than production zones 126 proximate heel 112 and point P2 having significantly higher production rates than production zones 126 proximate toe 114 and point P1.

Figure 2:
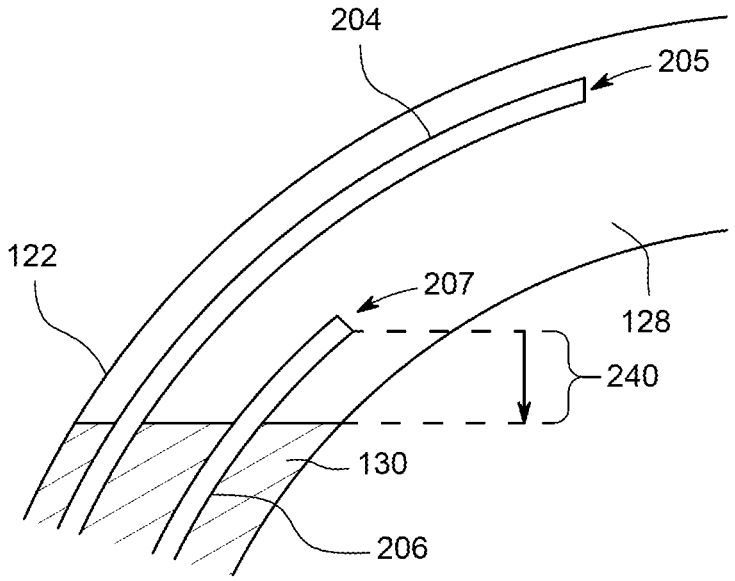
FIG. 2 is a schematic view of a portion of the gas vent system shown in FIG. 1.
Figure 3:
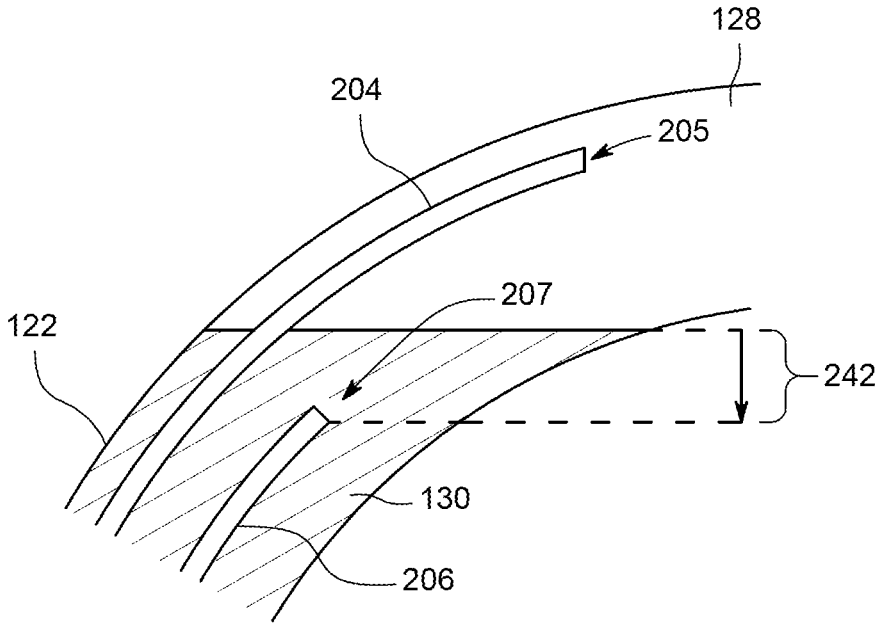
FIG. 3 is another schematic view of the gas vent system well shown in FIG. 2.

FIGS. 2 and 3 are detailed schematic views of the gas vent system within a portion of the horizontal portion of the wellbore representing two different stages operation of gas vent system 200, as described herein. For example, FIG. 2 illustrates both properly installed gas vent conduit 204 and gas probe conduit 206 in a horizontal portion of a wellbore. As shown in FIG. 2, gas vent intake passage 205 of gas vent conduit 204 and gas probe intake passage 207 of gas probe conduit 206 are both exposed only gaseous substances 128 portion of the horizontal portion of the wellbore. More specifically, in this first stage of operation, gas probe intake passage 207 is situated by first distance 240 above the surface level of the liquid portion 130 of the horizontal portion of the wellbore. Because gas probe intake passage 207 is fully exposed to gaseous substances 128 and the pressure of gaseous substances 128 is higher than the atmospheric pressure on the surface, gaseous substances 128 flow through gas probe conduit 206 through gas probe intake passage 207. Furthermore, at this first stage of operation, pump 132 is initiated and gas slugging may be beginning to occur. Additionally, the wellhead 138 may include a slug gas outlet (not shown) to relieve any pressure buildup at the surface end of the wellbore 104 experienced with gas slugs. Optionally, if the well operator is unaware of the location of both gas vent intake passage 205 and gas probe intake passage 207, both conduits are evacuated or purged of any liquid with any pressurized gas source on the surface (e.g., gas storage tank 232).

Still referring to FIG. 2, sensor 210, located on the surface, may begin measuring the flow rate of gaseous substances 128 through gas probe conduit 206 and generates a measurement signal for controller 214. In response to receiving this measurement signal from sensor 210, controller 214 generates a control signal command, based on one or more executing control routines via processor 216 and memory 218, that indicates the partial opening of gas vent choke valve 226. As a result, the free flow of gaseous substances 128 may occur through gas vent conduit 204. Substantially simultaneously, controller 214 also may generate a control signal to instruct gas probe choke valve 224 to partially open and allow gaseous substances 128 to free flow as well. As a result, the flow rate through gas probe conduit 206 is measured by sensor 210, and controller 214 receives measurement. In turn, the controller 214 continues measuring both conduits 204, 206 and automatically and incrementally open gas vent choke valve 226 to increase the evacuation of gaseous substances (while continually minimizing gas slugging and optimizing liquid production rate through pump 132). However, as gaseous substances 128 are removed from the horizontal portion of wellbore 108 (e.g., the head space of peak 118), the pressure of gaseous substances 128 begins decreasing and the liquid level in the horizontal portion of wellbore 108 begin rising relative to elevation. As the pressure decreases in the head space of peak 118, the flow rate measured by sensor 210 decreases and the controller 214 instructs the gas vent choke valve 226 to close. Advantageously, in this manner, gas vent system 200 regulates or modulates the liquid level with the head space of peak 118. Depending on production rates at production zones 126, the liquid level in head space of peak 118 may rise above level of gas probe intake passage 207.

As shown in FIG. 3, the level of liquid portion 130 contained in the horizontal portion of wellbore 108 has risen in elevation because gas vent choke valve 226 has allowed sufficient amount of gaseous substances 128 to escape to the surface, causing the pressure of gaseous substances 128 to decrease. As a result, gas probe intake passage 207 may become partially or entirely submerged under the level of liquid portion 130 by a particular distance 242. After the liquid level rises higher than gas probe intake passage 207, the flow rate (or alternatively, the pressure) measured by sensor 210 may significantly drop (e.g., to zero or near zero) because gas probe conduit 206 may be entirely flooded with liquid. In response to receiving a measurement signal from sensor 210 indicating that the flow rate of gas probe conduit 206 is zero, controller 214 commands gas vent choke valve 226 to close to a position closer to the initial position. Controller 214 may entirely purge gas probe conduit 206 by commanding gas vent control valve 220 to open and for gas multiplier 228 and/or pressurized gas storage tank 232 to release pressurized gas into gas probe conduit 206 at least the volume amount as the entire volume of gas probe conduit 206 (e.g., conduit area multiplied by conduit length), or a lesser volume of gas, as determined by the controller logic. This pressurized volume of gas may ensure that the evacuation of all liquid from gas vent conduit 206 is forced back into the horizontal portion of wellbore 108. If the water levels rises sufficiently high to partially or entirely submerge the gas vent conduit 204 (e.g., to a level higher than gas vent intake passage 207), controller 214 may entirely purge gas vent conduit 204 in a similar manner as described above for gas probe conduit 206.

Alternatively, controller 214 stores the current valve position (e.g., percentage or distance opened) of gas vent choke valve 226 and generates a control signal for gas vent choke valve 226 to entirely close. Continuing this alternative embodiment, controller 214 generates and transmits a control signal commanding gas vent choke valve 226 to open to a position to a closer to the initial position (i.e., entirely closed position) than at the previously stored position at the time gas probe conduit 206 flooded.

Regardless of the purging technique, gas probe choke valve 224 may be opened by a command from controller 214, and flow rate measurements may be obtained from gas probe sensor 210. Controller 214 may again incrementally open (or close) in gas vent choke valve 226 based at least on a flow rate measurement of the gas flowing through gas probe conduit 206 in attempting to discover an equilibrium setting for evacuating gaseous substances 128 at the maximum rate without flooding gas probe conduit 206. Because the rate of the production zones may change or other wellbore conditions may change, controller 214 includes the ability to dynamically change the valve positions, etc. in determining the equilibrium setting for evacuating gaseous substances 128. As result of changing production conditions or merely in finding the equilibrium setting for evacuating the optimal volume of gaseous substances 128, controller 214 may require multiple liquid evacuation purges from gas probe conduit 206.

Figure 4:
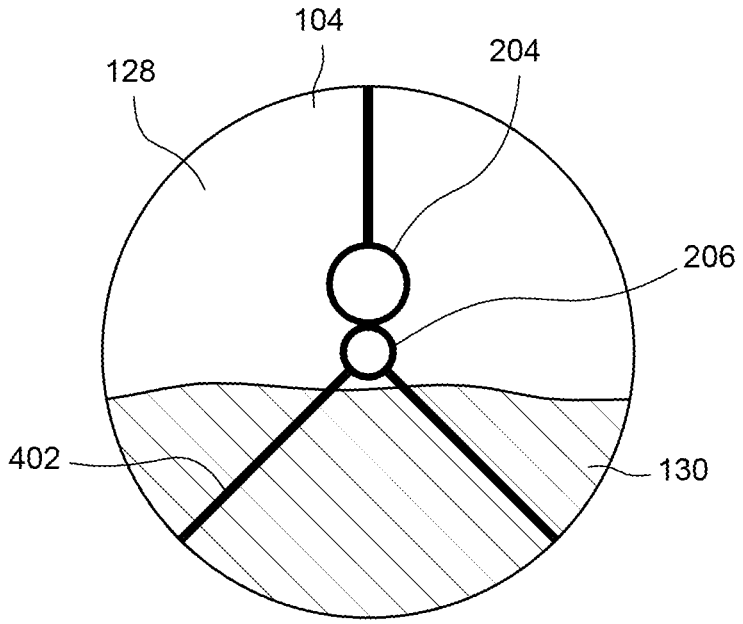
FIG. 4 is a cross-sectional view of a portion of the gas vent system shown in FIG. 1.

As shown in FIG. 4, a cross-sectional view of a portion of gas vent system 200 as shown in FIG. 1 along line "A-A". Wellbore 104 includes spacers 402 that allow for the precise positioning of gas vent conduit 206 and gas probe conduit 206 within wellbore 104. Spacers 402 may be constructed from any type of suitable material and may be configured in any way to allow for the positioning of conduits 204, 206. As shown in FIG. 4, both conduits 204, 206 are situated above the liquid level 130 in gaseous substance 128 headspace to allow for gaseous substances 128 to evacuate. For example, the gas vent system preferably positions gas vent conduit 204 (and gas vent intake passage 205) at a higher elevation at peak 118 than gas probe conduit 206 (and gas probe intake passage 207). Additionally, as shown in FIG. 4, the diameter of gas vent conduit 204 may be a different size from the diameter of gas probe conduit 206.

Figure 5:
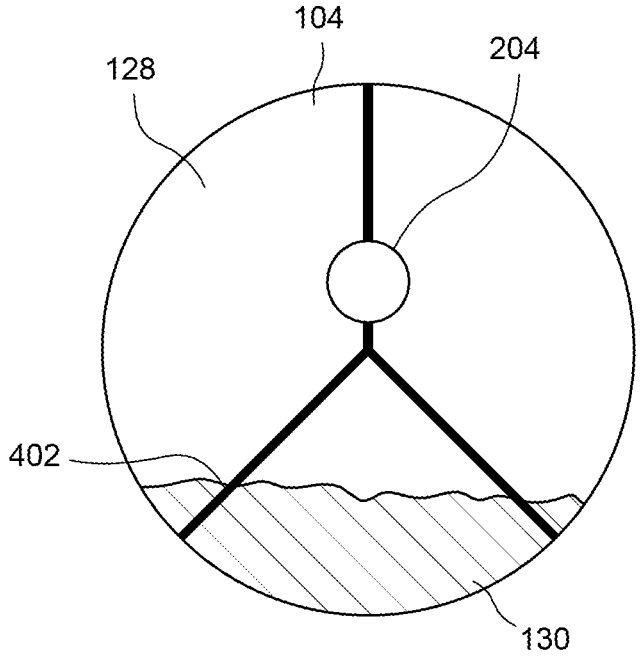
FIG. 5 is another cross-sectional view of a portion of the gas vent system shown in FIG. 1.
Figure 6:
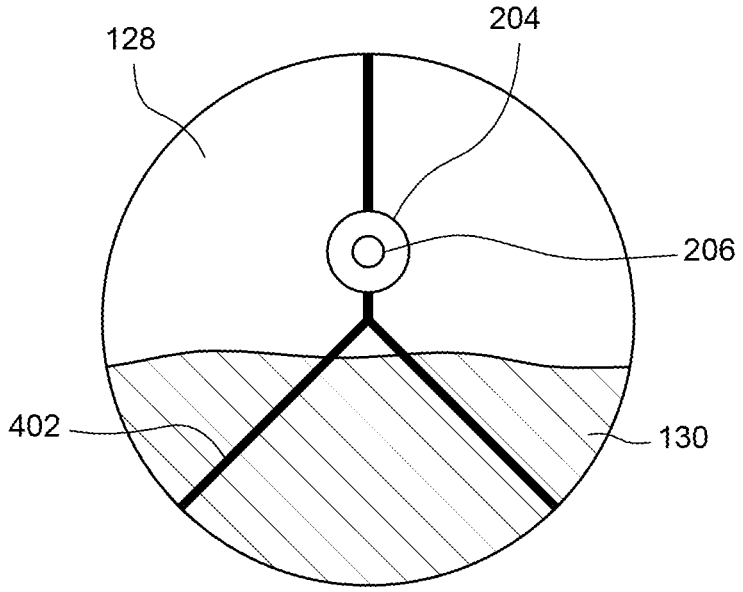
FIG. 6 is a cross-sectional view of a portion of an alternative gas vent system that may be used with the horizontal well shown in FIG. 1.
Figure 7:
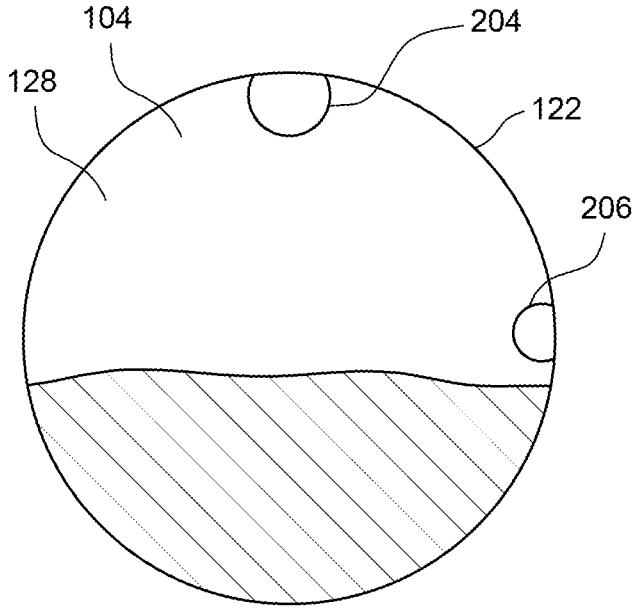
FIG. 7 is a cross-sectional view of a portion of another alternative gas vent system that may be used with the horizontal well shown in FIG. 1.

Similarly, as shown in FIG. 5, a cross-sectional view of a portion of gas vent system 200 as shown in FIG. 1 along line "B-B". Again, spacers 402 are configured to situated gas vent conduit 206 within wellbore 104 such that gas vent intake passage 205 may entirely open to gaseous substance 128 headspace, well above liquid level 130. Alternatively, FIG. 6 illustrates a cross-sectional view of another configuration of gas vent conduit 204 and gas prove conduit 206. In this alternative embodiment, gas probe conduit 206 is embedded wholly inside (i.e., situated annularly inward from) gas vent conduit 204 with conduit spacers (not shown) between the two conduits to support the structure of combination gas probe conduit 206 and gas vent conduit 204. In another alternative embodiment, as shown in FIG. 7, both gas probe conduit 206 and gas vent conduit 204 may be embedded into casing 122 of wellbore 104. In this configuration, the installation of the casing would advantageously include the installation of the gas vent system.

Figure 8:
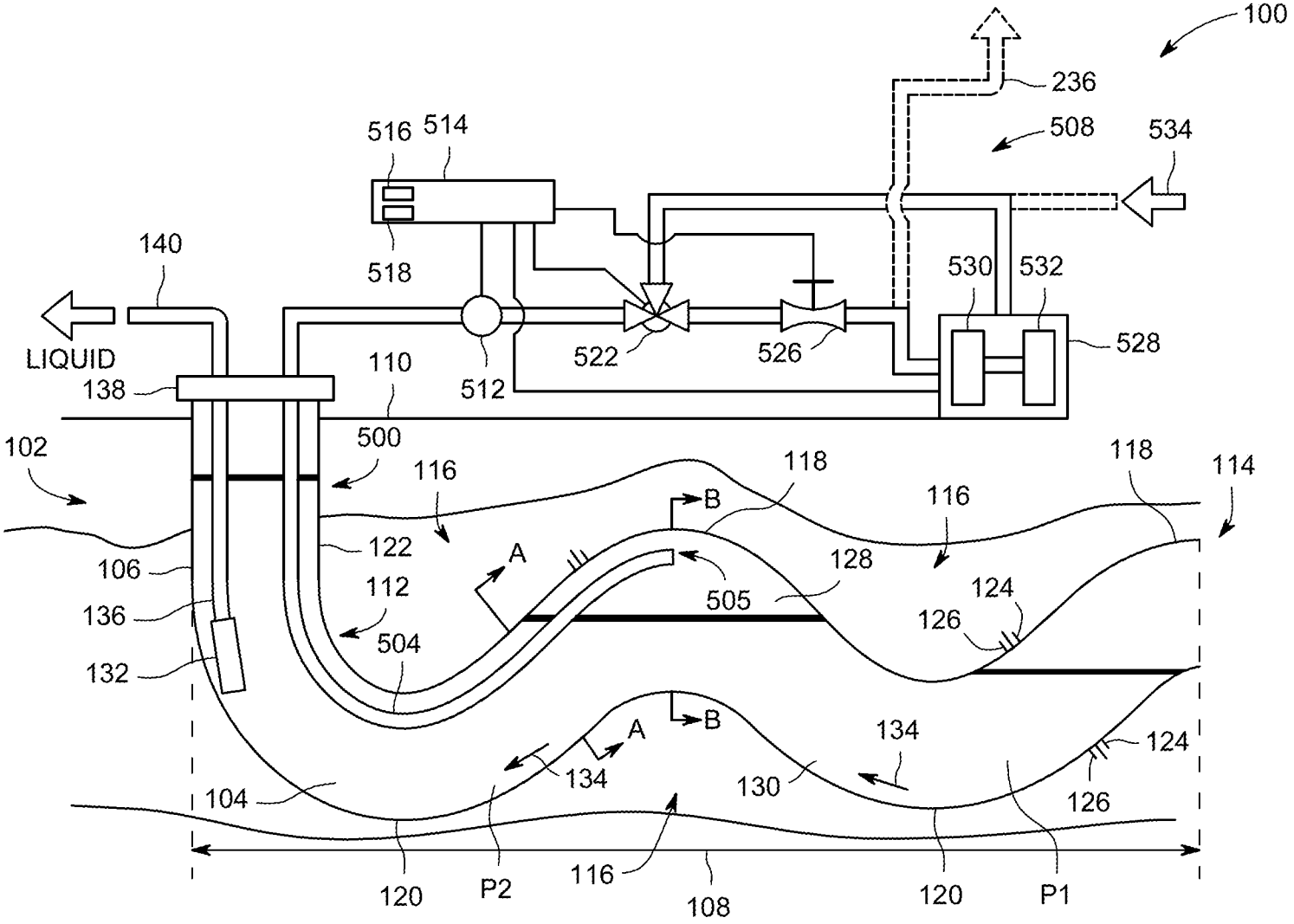
FIG. 8 is a schematic view of another exemplary horizontal well including an exemplary gas vent system.

In another embodiment, as shown in FIG. 8, an alternative gas vent system 500 includes at least one gas vent conduit 504 (including gas vent intake passage 505) which is coupled to surface equipment 508. In this alternative embodiment, gas vent conduit 504 is similarly configured to channel primarily gaseous substances 128 from within horizontal portion 108 of wellbore 104 through wellhead 138 to surface equipment 508. Generally, gas vent conduit 504 channels gas 128 to any location that facilitates operation of gas vent system 500 as described herein.

Surface equipment 508 includes a gas vent control valve 522 (e.g., three-way valve) coupled to gas vent conduit 504 that channels the gaseous substances 128 to gas multiplier 528 or alternatively, high pressure pipeline 534 or gas storage tank (not shown). Moreover, gas vent control valve 522 is coupled to a gas vent choke valve 526 (or any other suitable high pressure valve for controlling the flow rate of gaseous substances 128) and, in turn, the gas vent choke valve 526 is coupled to gas multiplier 528. Gas multiplier 528 includes a gas pressurizer 530 (or gas accumulator) and a pressurized gas purge tank 532 and facilitates the purging of gas vent conduit 504 (discussed below). Additionally or alternatively, any excess gaseous substances 128 evacuated from the wellbore may be disposed of through a flare 236.

Additionally, surface equipment 508 includes sensor 512 that is coupled to gas vent conduit 504. This sensor 512 includes a flow sensor or meter of any type, such as a turbine flow meter, Venturi meter, optical flow meters, or any other suitable flow meter, that operably measures or quantifies the rate of flow of gaseous substances through a conduit and generate an electronic signal (e.g., digital or analog). This periodic or aperiodic electronic signal is generated at a substantially instantaneous flow rate measurement or include a delay. Alternatively or additionally, sensor 512 includes a pressure sensor of an type (e.g., manometer, piezoelectric, capacitive, optical, electromagnetic, etc.) that measures a pressure of the gas in the conduit.

Moreover, a process controller 514 is communicatively coupled to sensor 512 and includes a processor 516 and a memory 518 that are configured to receive and store measurement monitoring signals from the sensor 512. In turn, processor 516 and memory 518 execute control routines or loops to generate one or more control signals to control any piece of the surface equipment 508 (discussed below). These control routines, executed by controller 514 via processor 516 and memory 518, are configured to generate one or more control signals based any number of control algorithms or techniques, such as proportional-integral-derivative (PID), fuzzy logic control, model-based techniques (e.g., Model Predictive control (MPC), Smith Predictor, etc.), or any other control technique including adaptive control techniques.

Controller 514 generates and transmit one or more control signals to instruct or control valves 522, 526 (and optionally gas multiplier 528). For example, controller 514 receives a flow measurement monitoring signal from sensor 512. In response to determining that the flow measurement monitoring signal is relatively a high value, controller 514 generates and transmits to gas vent choke valve 526 a control signal that commands the incremental opening of the passage through gas vent choke valve 526, facilitating the flow of gaseous substances 128 from the gaseous pocket(s) in the wellbore. On the other hand, in response to determining that the flow measurement monitoring signal is relatively a low value, controller 514 generates and transmits to gas vent choke valve 526 a control signal that commands the incremental closing of the passage through gas vent choke valve 526, restricting the volume and flow of gaseous substances 128 from the gaseous pocket(s) in wellbore. Additionally, the wellhead 138 may include a slug gas outlet (not shown) to relieve any pressure buildup at the surface end of the wellbore 104 experienced with gas slugs.

In any event, sensor 512 may begin measuring the flow rate of gaseous substances 128 through gas vent conduit 504 and generates a measurement signal for controller 514. In response to receiving this measurement signal from sensor 512, controller 514 generates a control signal command, based on one or more executing control routines via processor 516 and memory 518, that indicates the partial opening of gas vent choke valve 526. As a result, the free flow of gaseous substances 128 may occur through gas vent conduit 504. In turn, the controller 514 continues measuring gas vent conduit 504 and automatically and incrementally opens gas vent choke valve 526 to increasingly facilitate the evacuation of gaseous substances (while continually minimizing gas slugging and optimizing liquid production rate through pump 132). However, as gaseous substances 128 are removed from the horizontal portion of wellbore 108 (e.g., the head space of peak 118), the pressure of gaseous substances 128 begins decreasing and the liquid level in the horizontal portion of wellbore 108 begin rising relative to elevation. As the pressure decreases in the head space of peak 118, the flow rate measured by sensor 512 decreases and the controller 514 instructs the gas vent choke valve 526 to close. Advantageously, in this manner, gas vent system 500 regulates or modulates the liquid level with the head space of peak 118. Depending on production rates at production zones 126, the liquid level in head space of peak 118 may rise above level of gas vent intake passage 505 because gas vent choke valve 526 has allowed sufficient amount of gaseous substances 128 to escape to the surface, causing the pressure of gaseous substances 128 to decrease.

As a result, gas vent intake passage 505 may become partially or entirely submerged under the level of liquid portion 130 by a particular distance. After the liquid level rises higher than gas vent intake passage 505, the flow rate (or alternatively, the pressure) measured by sensor 512 may significantly drop (e.g., to zero or near zero) because gas vent conduit 504 may be partially or entirely flooded with liquid. In response to receiving a measurement signal from sensor 512 indicating that the flow rate of gas vent conduit 504 is zero (or significantly decreases), controller 514 may entirely purge gas vent conduit 504. The controller 514 may instruct gas vent control valve 526 to open and for gas multiplier 528 and/or pressurized gas storage tank 532 to release pressurized gas into gas vent conduit 504 at a volume equal to gas vent conduit 504 (e.g., conduit area multiplied by conduit length), or a lesser volume of gas, as determined by the controller logic. A high pressure pipeline 234 may also be utilized in purging gas vent conduit 504. This pressurized volume of gas may ensure the evacuation of all liquid from gas vent conduit 506 is forced back into the horizontal portion of wellbore 108.

After purging, controller 514 may again incrementally open (or close) in gas vent choke valve 526 based at least on a flow rate measurement of the gas flowing through gas vent conduit 504 in attempting to discover an equilibrium setting for evacuating gaseous substances 128 at the maximum rate without flooding gas vent conduit 504. Because the rate of the production zones may change or other wellbore conditions may change, controller 514 includes the ability to dynamically change the valve position, etc. in determining the equilibrium setting for evacuating gaseous substances 128. As result of changing production conditions or merely in finding the equilibrium setting for evacuating the optimal volume of gaseous substances 128, controller 514 may require multiple liquid evacuation purges from gas vent conduit 504.

The above described horizontal well systems facilitate efficient methods of well operation. Specifically, in contrast to many known well completion and production systems, the horizontal well systems as described herein substantially remove gaseous substances from a wellbore that substantially reduces the formation of gas slugs in the wellbore.

As such, the gas vent system described herein provides gaseous substances with an escape path that bypasses the pump and removes substantially all of the gaseous substances from within the horizontal portion of the wellbore prior to the gases reaching the pump such that only the liquid mixture encounters the pump. Alternatively, the gas vent systems described herein are used in horizontal wells that seek to recover only gaseous substances, and, therefore, do not include a pump. Accordingly, the gas vent systems described herein substantially eliminate both the buildup of pressure upstream from the pump and the formation of slugs, as described above. More specifically, the gas vent systems described herein substantially reduce the buildup of pressure within the wellbore such that the horizontal portion of the wellbore achieves a nearly constant minimum pressure along its length that maximizes the production rate and the total hydrocarbon recovery of the horizontal well.

An exemplary technical effect of the methods, systems, and apparatus described herein includes at least one of: (a) maximizing the production rate of a well by achieving a constant minimum pressure along a horizontal length of the wellbore; and (b) reducing the operational costs of the well by protecting the pump from inhaling gas slugs that may cause a reduction in the expected operational lifetime of the pump.

Exemplary embodiments of methods, systems, and apparatus for removing gas slugs from a horizontal wellbore are not limited to the specific embodiments described herein, but rather, components of systems and steps of the methods may be utilized independently and separately from other components and steps described herein. For example, the methods may also be used in combination with other wells, and are not limited to practice with only the horizontal well systems and methods as described herein. Rather, the exemplary embodiment can be implemented and utilized in connection with many other applications, equipment, and systems that may benefit from creating independent gas and liquid flow paths.

Although specific features of various embodiments of the disclosure may be shown in some drawings and not in others, this is for convenience only. In accordance with the principles of the disclosure, any feature of a drawing may be referenced and claimed in combination with any feature of any other drawing.

Some embodiments involve the use of one or more electronic or computing devices. Such devices typically include a processor or controller, such as a general purpose central processing unit (CPU), a graphics processing unit (GPU), a microcontroller, a reduced instruction set computer (RISC) processor, an application specific integrated circuit (ASIC), a programmable logic circuit (PLC), and/or any other circuit or processor capable of executing the functions described herein. The methods described herein may be encoded as executable instructions embodied in a computer readable medium, including, without limitation, a storage device and/or a memory device. Such instructions, when executed by a processor, cause the processor to perform at least a portion of the methods described herein. The above examples are exemplary only, and thus are not intended to limit any way the definition and/or meaning of the term processor.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A gas vent system for use in a wellbore that includes a vertical portion, a substantially horizontal portion having a peak and a valley with an updip therebetween, a heel between the vertical portion and the horizontal portion, and a pump positioned in the vertical portion proximate the heel, the wellbore configured to channel a mixture of fluids, the gas vent system comprising:

a gas vent conduit positioned within the wellbore, the gas vent conduit defining a gas vent intake passage situated within the substantially horizontal portion of the wellbore at the peak or the updip and configured to facilitate therethrough a flow of gaseous substances collected at the peak or the updip;

a gas probe conduit positioned within the wellbore, the gas probe conduit defining a gas probe intake passage within the substantially horizontal portion of the well bore, wherein the gas probe intake passage is situated at a different location at a lower elevation and downstream of the gas vent intake passage and configured to facilitate a second flow of gaseous substances collected in the wellbore therethrough; and a gas vent valve coupled to the gas vent conduit and situated outside the wellbore, wherein the gas vent valve controls the flow of gaseous substances through the gas vent conduit based at least in part on a liquid level measurement from the gas probe conduit.

2. The gas vent system in accordance with claim 1, further comprising:

a controller configured to:

open the gas vent valve to a first position that facilitates a first rate of flow of gaseous substances through the gas vent conduit through the gas vent intake passage;

receive a first gas vent flow measurement from the first rate of flow of gaseous substances through the gas vent conduit; and adjust the gas vent valve to a second position that facilitates a second rate of flow of gaseous substances through the gas vent conduit based on the first gas vent flow measurement, wherein the second rate of flow of gaseous substances is different from the first rate of flow of gaseous substances.

3. The gas vent system in accordance with claim 2, wherein the controller is further configured to purge the gas vent conduit with pressurized gas in response to a determination that the first gas vent flow measurement is substantially zero or significantly decreases.

4. The gas vent system in accordance with claim 3, wherein the controller is further configured to:

receive a second gas probe flow measurement from a second rate of flow of gaseous substances through the gas vent conduit; and adjust the gas vent valve to a third position that facilitates a third rate of flow of gaseous substances through the gas vent conduit in response to the determination that the at least one gas vent flow measurement is a non-zero value.

5. The gas vent system in accordance of claim 1, wherein the controller is further configured to receive a pressure measurement from the gas vent conduit.

6. The gas vent system in accordance with claim 1, wherein the gas probe conduit includes a first diameter and the gas vent conduit includes a second diameter, wherein the first diameter and the second diameter are different.

7. The gas vent system in accordance with claim 1, wherein the gas vent conduit and the gas probe conduit are embedded into a casing of the wellbore.

8. The gas vent system in accordance with claim 1, wherein the gas probe conduit is situated annularly inward from the gas vent conduit.

9. The gas vent system in accordance with claim 1, wherein the gas vent conduit bypasses the pump.

10. The gas vent system in accordance with claim 1, wherein the peak or the updip of the substantially horizontal portion of the wellbore is located between a heel and a toe of the wellbore.

11. A method of venting gas from a wellbore that includes a substantially horizontal portion having a peak and a valley with an updip therebetween, the wellbore configured to channel a mixture of fluids, the method comprising:

positioning a gas vent conduit within the wellbore, the gas vent conduit including a gas vent intake passage situated within the peak or the updip of the substantially horizontal portion of the wellbore;

positioning a gas probe conduit within the wellbore, the gas probe conduit including a gas probe intake passage, wherein the gas probe intake passage is situated in the substantially horizontal portion of the wellbore at a different location, at a lower elevation, and downstream of the gas vent intake passage; and facilitating a first flow of gaseous substances collected in the peak or the updip through the gas vent conduit, wherein the first flow of gaseous substances through the gas vent conduit is controlled by a gas vent valve situated outside the wellbore, wherein the first flow of gaseous substances is based at least in part on a liquid level measurement from the gas probe conduit.

12. The method in accordance with claim 11 further comprising:

opening, using a controller, the gas vent valve to a first position that facilitates the first flow of gaseous substances through the gas vent conduit;

receiving, using the controller, a gas vent flow measurement from the first flow of gaseous substances through the gas vent conduit; and adjusting, using the controller and based on the gas vent flow measurement, the gas vent valve to a second position that allows a second rate of flow of gaseous substances through the gas vent conduit different from the first flow of gaseous substances.

13. The method in accordance with claim 12 further comprising purging the gas vent conduit with pressurized gas in response to a determination that the gas vent flow measurement is substantially zero or significantly decreases.

14. The method in accordance with claim 11 further comprising:

facilitating a second flow of gaseous substances collected in the wellbore through the gas probe conduit.

15. The method in accordance with claim 14 further comprising:

receiving a first gas probe flow measurement from a second rate of flow of gaseous substances through the gas probe conduit, and in response to the determination that the second gas probe flow measurement is a non-zero value, adjusting the gas vent valve to a third position that facilitates a third rate of flow of gaseous substances through the gas vent conduit.

16. The method in accordance of claim 15, wherein receiving the first gas probe flow measurement includes receiving a pressure measurement from the gas probe conduit.

17. The method in accordance with claim 15, wherein the gas probe conduit includes a diameter different from a diameter of gas vent conduit.

18. The method in accordance with claim 15, wherein the gas vent conduit and the gas probe conduit are embedded within a casing of the wellbore.

19. The method in accordance with claim 15, wherein the gas probe conduit is situated annularly inward from the gas vent conduit.

* * * * *